US005420478A

United States Patent [19]

Scheitrum

[11] Patent Number: 5,420,478

[45] Date of Patent: May 30, 1995

[54] DEPRESSED COLLECTOR FOR SORTING RADIAL ENERGY LEVEL OF A GYRATING ELECTRON BEAM

[75] Inventor: Glenn P. Scheitrum, San Mateo, Calif.

[73] Assignee: Litton Systems, Inc., Beverly Hills, Calif.

[21] Appl. No.: 16,832

[22] Filed: Feb. 12, 1993

[51] Int. Cl.[6] ..... H01J 23/027

[52] U.S. Cl. ..... 315/5.38; 315/5.31

[58] Field of Search ..... 315/5.38, 5.31

[56] References Cited

U.S. PATENT DOCUMENTS

| | | | |
|---|---|---|---|
| 3,368,102 | 2/1968 | Saharian | 315/5.38 X |
| 3,764,850 | 10/1973 | Kosmahl | 315/5.35 X |
| 4,395,656 | 7/1983 | Kosmahl | 315/5.35 X |
| 4,621,219 | 11/1986 | Fox et al. | 315/5.38 X |
| 4,794,303 | 12/1988 | Hechtel et al. | 315/5.38 X |
| 4,912,366 | 3/1990 | Dionne | 315/5.31 X |
| 4,933,594 | 6/1990 | Faillon et al. | 315/5.38 X |

OTHER PUBLICATIONS

"Modern Multistage Depressed Collectors–A Review", by Henry G. Kosmahl, Proceedings of the IEEE, vol. 70, No. 11, Nov. 1982.

*Primary Examiner*—Benny T. Lee

*Attorney, Agent, or Firm*—Graham & James

[57] ABSTRACT

A depressed collector is provided which is capable of recovering energy from a large orbit gyrating electron beam received from a microwave device, such as a gyrotron. The depressed collector sorts and collects the electrons of the spent electron beam on the basis of their radial energy levels. The depressed collector comprises a plurality of stages of electrodes. Each of the electrode stages have a negative potential applied thereto, with the first of the electrode stages having the greatest negative potential with respect to the microwave device, and the subsequent stages having decreasing relative potential. The depressed collector will sort the electrons from the gyrating electron beam in accordance with their radial energy, with electrons having the highest radial energy being collected on the first electrode, and electrons having lesser amounts of radial energy being collected on the subsequent electrodes.

15 Claims, 2 Drawing Sheets

FIG. 1 PRIOR ART
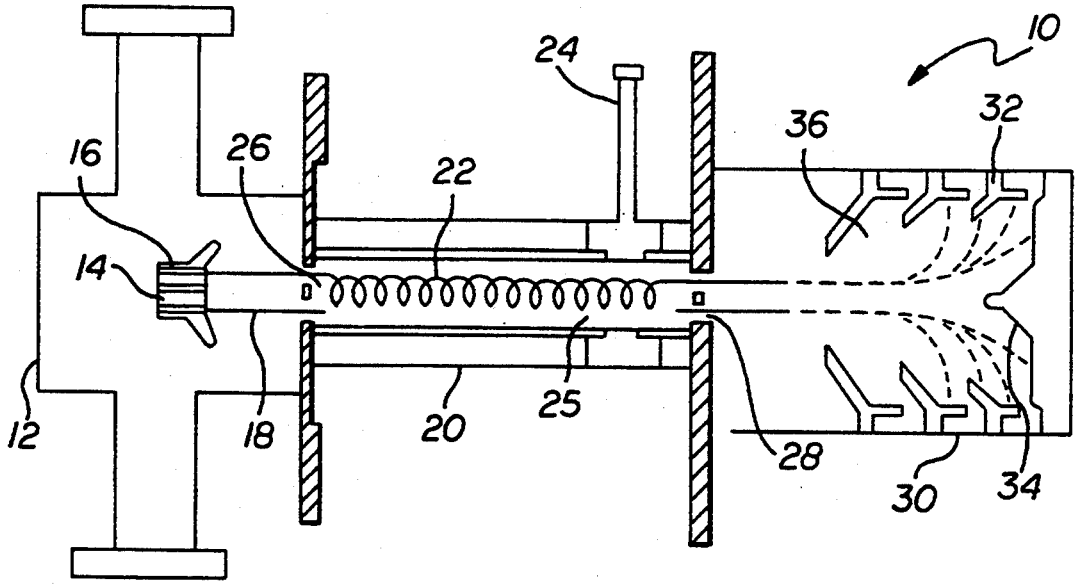
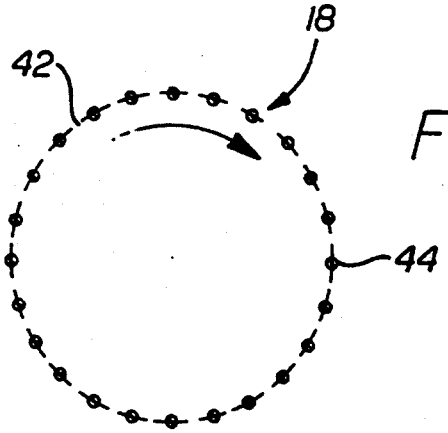
FIG. 2
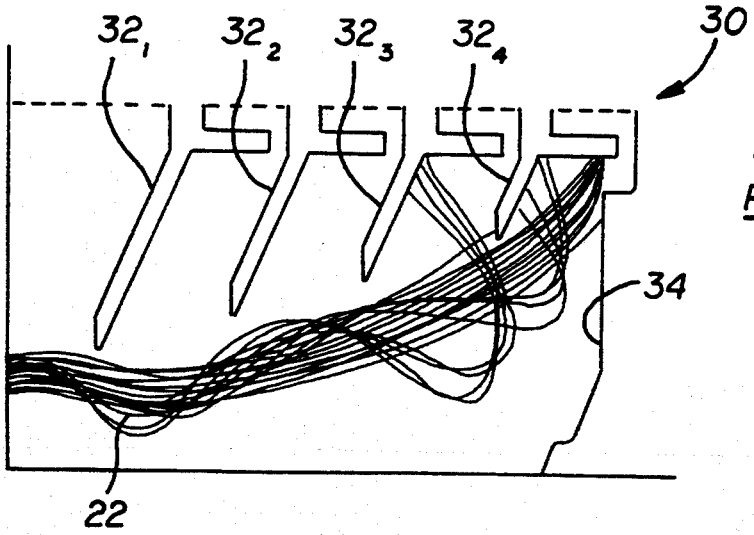
FIG. 3
PRIOR ART

DEPRESSED COLLECTOR FOR SORTING RADIAL ENERGY LEVEL OF A GYRATING ELECTRON BEAM

BACKGROUND OF THE INVENTION

1. Field of the Invention

The present invention relates to an improved electron beam collector, and more particularly, to a multistage depressed collector capable of efficiently recovering the energy of a large orbit electron beam.

2. Description of Related Art

It is well known in the art to utilize a linear beam device such as a traveling wave tube (TWT), klystron, or coupled cavity tube to produce microwave power. In a linear beam device, an electron beam originating from an electron gun is caused to propagate through a tunnel or a drift tube generally containing an RF interaction structure. At the end of its travel, the electron beam is deposited within a collector or beam dump which effectively captures the spent electron beam. The beam is generally focused by magnetic or electrostatic fields in the interaction structure of the device in order for it to be effectively transported from the electron gun to the collector without loss to the interaction structure. An RF wave can be made to propagate through cavities within the interaction structure and interact with the electron beam which gives up energy to the propagating wave. Thus, the microwave device may be used as an amplifier for increasing the power of a microwave signal.

In one particular type of electron gun, a hollow electron beam is formed. By varying the axial magnetic field, the electrons in the hollow beam can be made to orbit some of the magnetic flux lines. As the magnetic field is increased, a significant fraction of the axial energy of the electron beam is converted to motion transverse to the beam axis. This gyrating beam is used in several types of microwave devices which convert the transverse energy of the beam into RF energy. Examples of these devices are the peniotron, gyrotron, gyroBWO, gyroTWT, etc. A prior art gyrotron is shown in FIG. 1.

The hollow beam can be characterized as either a large orbit beam in which the electrons spiral about a guiding center of the beam near the axis of the microwave device, or a small orbit beam in which the electrons orbit around individual flux lines of the guiding magnetic field in the interaction region. The rotation of the electrons in a large orbit beam is induced by a magnetic field reversal at the front end of the interaction region. A large orbit beam is shown graphically in FIG. 2.

To operate the microwave device efficiently, the spent electrons which pass through the interaction region must be collected and returned to the voltage source. Any remaining energy in the electrons is released in the form of heat when they strike a stationery element, such as the walls of the collector. One type of collector, known as a depressed collector, is operated at a negative voltage with respect to the body of the microwave device. By operating at a depressed state, the electric field within the collector slows the moving electrons so that the electrons can be collected at a reduced velocity. This method increases the electrical efficiency of the RF device as well as reducing undesirable heat generation within the collector. Depressed collectors are discussed in U.S. Pat. No. 4,794,303, by Hechtel et al., which is assigned to the same assignee as the present invention, and which is incorporated herein by reference.

A depressed collector typically comprises a cylindrical structure having a plurality of electrodes arranged in stages. Each electrode stage of the collector has a negative voltage of increasing potential, such that the first stage has the lowest potential and the final stage has the greatest potential. In a linear beam device, the electrons with the lowest axial energy would be collected on the first stage electrode, while the electrons having the highest axial energy would travel to the latter stages for collection. The electrode potentials of a multi-stage depressed collectors are selected for efficient collection of a maximum amount of beam current at the lowest incident velocity.

However, a large orbit gyrating electron beam can not be directly collected by a typical multi-stage depressed collector. In a gyrating beam, the ratio of transverse velocity to axial velocity of the beam, known as $\alpha$, is usually between 1 and 2. Since increasing $\alpha$ will raise the efficiency of the microwave device, it is common for such devices to be operated at the highest $\alpha$ until a point is reached in which the device becomes unstable. Accordingly, high $\alpha$ electron beams have a majority of their kinetic energy in the transverse direction. Once the gyrating beam exits the interaction region and enters the collector, the absence of a controlling magnetic field causes the electron beam to expand rapidly. Consequently, the unguided beam impacts a generally thin cylindrical portion of the collector. In so doing, a majority of the electrons would be collected on the first stage of the multi-stage collector, significantly reducing the overall efficiency of the microwave device.

A solution which enables a typical multi-stage depressed collector to be used with a gyrating beam involves conversion of the beam's transverse velocity into axial velocity. This can be accomplished by adding a second magnetic field reversal at the end of the interaction region adjacent to the collector. By reversing the magnetic field, the rotation of the electrons in the beam about the guiding center is effectively terminated. The linearized beam can then be collected in a multi-stage depressed collector in the usual manner.

In practice, this method reduces the efficiency of the microwave device. Additional energy must be devoted to the magnetic field reversal. In addition, the overall device length must be increased to take into account the axial length of the magnetic field reversal region, and the increased axial length of the multi-stage depressed collector.

Thus, there is a need to provide a multi-stage depressed collector for use with a large orbit gyrating electron beam in which the electrons can be sorted and collected on the basis of their transverse rotational energy, and which does not require a second magnetic field reversal to linearize the beam. It would also be desirable if such a collector would have generally reduced axial length over conventional multi-stage depressed collectors.

SUMMARY OF THE INVENTION

In addressing these problems, the present invention provides a depressed collector capable of dissipating a large orbit gyrating electron beam received from a microwave device, such as a gyrotron. The depressed collector sorts and collects the electrons of the spent electron beam on the basis of their relative transverse energy levels.

The depressed collector is disposed within a housing secured to the microwave device, and comprises a plurality of stages of electrodes. The housing has an inwardly flared aperture through which the gyrating beam passes. Each of the electrode stages have a negative potential applied thereto, with the first of the electrode stages having the greatest negative potential with respect to the microwave device, and the subsequent stages having decreasing relative potential. The electrodes have a generally funnel shape with a generally flat internal leading edge. A conical shaped central electrode extends from a back wall of the collector and protrudes inwardly into a central portion of the collector housing to a substantial axial extent of the overall collector depth.

The depressed collector will sort the electrons from the gyrating electron beam in accordance with their transverse velocity, with electrons having the highest transverse velocity being collected on the first electrode, and electrons having lesser amounts of transverse velocity being collected on the subsequent electrodes. Electrons having the least transverse energy will be collected on the central electrode. In a preferred embodiment of the invention, the potential on the first electrode is equal to the potential between the cathode and the anode of the electron gun of the microwave device.

A more complete understanding of the depressed collector of the present invention will be afforded to those skilled in the art as well as a realization of additional advantages and objects thereof, by a consideration of the following detailed description of the preferred embodiment. Reference will be made to the appended sheets of drawings, which will be first described briefly.

BRIEF DESCRIPTION OF THE DRAWINGS

FIG. 1 is a diagrammatic side view of a prior art hollow beam gyrotron having an electron gun assembly, an interaction area, and a collector;

FIG. 2 is a sectional view of a gyrating electron beam;

FIG. 3 is a side sectional view of a prior art multistage depressed collector as in FIG. 1.

DESCRIPTION OF THE PREFERRED EMBODIMENT

Figure 4:
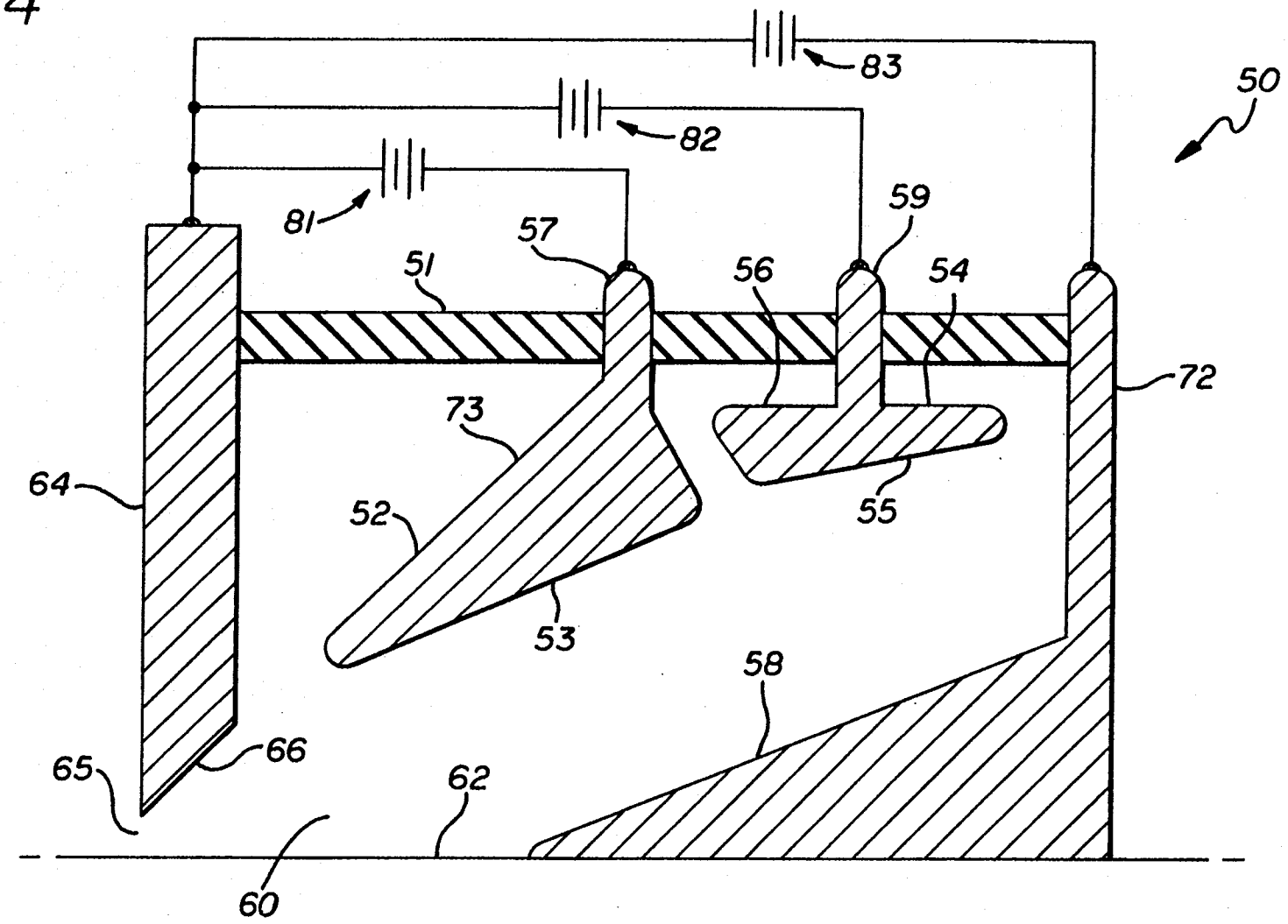
FIG. 4 is a side sectional view of the improved depressed collector of the present invention.

The present invention represents a significant improvement over the prior art depressed collectors, in that it permits a large orbit electron beam to be efficiently collected without having to transfer rotational energy back to axial energy.

Referring first to FIG. 1, a prior art gyrotron 10 is shown. An electron gun assembly 12 has a thermionic emitting cathode 14 with an emitting surface 16 that emits a circular electron beam 18. The beam 18 passes from the electron gun assembly 12 into an interaction structure 20 through a centrally disposed interaction region 25 of the structure. A magnetic field reversal occurs at an initial portion 26 of the interaction structure 20, which imparts an angular velocity on the electron beam, resulting in the beam spiraling as shown at 22. FIG. 2 illustrates a gyrating electron beam 18 comprising individual electrons 44 spiraling in a generally circular path 42. An RF wave is introduced into the interaction structure 20 through one or more couplers 24. The RF wave interacts with the spiraling beam and energy from the beam transfers to the moving wave.

At the end of the interaction structure 20, the spent electron beam exits the interaction region 25 through the second aperture 28 and is collected in the collector 30. Before exiting the interaction structure 20, the spiraling beam 22 passes a second magnetic field reversal, which linearizes the gyrating beam. The now linearized beam enters the internal space 36 of the collector 30 and is rapidly decelerated by the numerous stages of depression electrodes 32 and the back wall 34.

As shown in FIG. 3, each of the stages of depression electrodes $32_1$, $32_2$, $32_3$, $32_4$ have increasingly negative potentials with respect to the microwave device to rapidly decelerate the electrons of the linearized beam 22. This way, only a small portion of the electrons of beam 22 reach the back wall 34 of the collector 30. By collecting the electrons in this manner, the electrons do not focus on any one individual area in the collector, which would generate excess heat that can overstress or cause damage to the collector 30.

As explained above, this prior art collector has an inherent inefficiency, since energy must be devoted to linearizing the beam. Moreover, the magnetic field reversal region and the axial beam collection method increase the axial length requirement of the overall microwave device.

Referring now to FIG. 4, there is shown a depressed collector 50 of the present invention. The collector 50 has a support structure 51 which is secured to the wall 64 of the microwave device. The wall 64 can be either shared with the microwave device, or can be a separate member which is electrically connected to the microwave device. The electrical potential at the wall 64 is at ground. The collector structure 51 is generally cylindrical in shape, as are a majority of the internal components of the collector. Due to the cylindrical geometry, the elements shown in FIG. 4 are symmetrically disposed about the centerline 62 of the collector 50, which is an axis of symmetry of the collector. A back portion 72 secures to the structure 51, enclosing an internal space 60 within the collector 50.

The centerline 62 is coincident with the axis of the gyrating electron beam exiting from the microwave device, and an entrance aperture 65 is disposed in the rear wall 64 along the centerline 62. The aperture 65 has a flared inner surface 66 which diverges in the direction of the collector 50.

A plurality of electrodes are mechanically supported by the cylindrical structure 51. It is anticipated that the cylindrical structure 51 be formed of a thermally conductive and electrically insulative material, such as ceramic, so that the electrodes which extend through the cylindrical structure 51 are electrically insulated from one another and from the microwave device.

A first electrode 52 has a generally funnel shape with an outer annular portion 57 which extends partially through the cylindrical structure 51. The annular portion 57 provides for the connection of the electrode 52 with an external voltage source 81. The first electrode 52 has an outer surface 73 and an inner surface 53. The outer surface 73 is disposed at an angle with respect to the structure 51, and is generally pointing toward the aperture 65. The inner surface 53 also points towards the aperture 65, but has a shallower angle with respect to the structure 51. A highly negative potential with respect to the microwave device is applied to the first electrode 52, which produces a generally saddle-shaped electric field region about the electrode.

A second electrode 54 is disposed subsequent to the first electrode axially within the collector 50. The second electrode 54 has an inner surface 55 and an outer surface 56, and also has an annular portion 59 which extends partially through the cylindrical structure 51 for attachment to an external voltage source 82. The second electrode 54 is also funnel shaped, however, its outer surface 56 is nearly cylindrical, while the inner surface 55 is roughly parallel to the inner surface 53 of the first electrode. A negative potential with respect to the microwave device is applied to the second electrode 54 that is substantially lower than the potential applied to the first electrode 52, which produces a generally cylindrical-shaped electric field region about the electrode.

A central electrode 58 extends inwardly from the back portion 72 of the collector 50. The central electrode 58 is conical shaped, and protrudes to a substantial extent along the centerline 62 of the collector 50. A voltage source 83 is connected to the central electrode 58, which applies a negative potential with respect to the microwave device that is substantially lower than the potential applied to the second electrode 54 or the first electrode 52.

In operation, the absence of a magnetic field within the collector causes the beam to expand rapidly upon entry into the collector 50. The rotational energy of the electron beam is converted to radial velocity as the beam enters the collector. Electrons which have lost energy to the microwave interaction have less radial velocity. A majority of the electrons entering through the aperture 65 hit surface 53 of the first electrode 52. Electrons having the highest amount of energy impact surface 53 of the electrode 52, while electrons having reduced energy penetrate further into the collector striking impacting surface 55 of the electrode 54. Electrons having the least amount of energy hit the central electrode 58.

To achieve the highest collection efficiency, the potential of the first electrode 52 should be equal to the potential of the cathode of the microwave device. In the preferred embodiment of the invention, the potential of the first electrode 52, second electrode 54, and central electrode 58 is −60 kilovolts, −30 kilovolts and −10 kilovolts, respectively.

Having thus described a preferred embodiment of an improved depressed collector, it should now be apparent to those skilled in the art that the aforestated objects and advantages for the within system have been achieved. Although the present invention has been described in connection with the preferred embodiment, it is evident that numerous alternatives, modifications, variations, and uses will be apparent to those skilled in the art in light of the foregoing description. For example, alternative materials, joining techniques, voltages, and spacing can be selected to vary the operating characteristics of a depressed collector as contemplated by the invention.

The present invention is further defined by the following claims:

What is claimed is:

1. A depressed collector operatively connected to a microwave device generating an electron beam comprised of individual electrons having varying levels of radial energy, said electron beam gyrating about a common axis associated with said microwave device and said collector, said collector recovering energy of said gyrating electron beam after said beam has exited said microwave device, said collector comprising:

means for sorting said individual electrons of said electron beam on the basis of their respective radial energy levels, the sorting means comprising a plurality of stages, with said individual electrons having the highest radial energy being collected at a first one of said stages, and said individual electrons having lesser amounts of radial energy being collected at respective subsequent ones of said stages;

wherein a majority of the energy of the individual electrons within the collector is in a direction transverse to said axis.

2. The depressed collector of claim 1, wherein a first one of said electrode stages is generally funnel shaped, and has surfaces which converge toward said axis.

3. A depressed collector operatively connected to a microwave device generating an electron beam comprised of individual electrons having varying levels of radial energy, said electron beam gyrating about a common axis associated with said microwave device and said collector, said collector recovering energy of said gyrating electron beam after said beam has exited said microwave device, said collector comprising:

means for sorting said individual electrons of said electron beam on the basis of their respective radial energy levels, the sorting means comprising a plurality of stages, with said individual electrons having the highest radial energy being collected at a first one of said stages, and said individual electrons having lesser amounts of radial energy being collected at respective subsequent ones of said stages;

wherein a majority of the energy of the individual electrons within the collector is in a direction transverse to said axis, and wherein each of said stages comprises an electrode having a respective negative potential applied thereto, the first one of the electrode stages having applied the greatest negative potential with respect to the microwave device, and subsequent electrodes respectively having applied generally decreasing relative potential.

4. The depressed collector of claim 3, wherein said microwave device further comprises a cathode having a potential applied thereto, said cathode emitting said beam in response to said potential, and said greatest negative potential of said first electrode stage is equal to the potential that is applied to said cathode of said microwave device.

5. A depressed collector operatively connected to a microwave device having an interaction region, said microwave device generating a gyrating beam that passes through said interaction region and into said collector, the collector comprising:

an insulating support structure coupled to an end of the microwave device, the structure being enclosed at a rear end thereof, and having an aperture at a forward end thereof for passage of said beam from said interaction region to said structure;

a first electrode disposed within said structure and having a highly negative potential applied thereto;

a second electrode disposed within said structure between said first electrode and said rear end of said structure, said second electrode having a high negative potential applied thereto which is significantly less than the potential applied to said first electrode;

a central electrode extending from said rear end of said structure, the central electrode having a negative potential applied thereto which is significantly less than the potential applied to said second electrode;

wherein, electrons of said beam have varying levels of radial energy and are sorted according to their respective radial energy levels with electrons having the highest radial energy being collected on said first electrode, and electrons having less radial energy being collected on one of said second electrode and said central electrode depending on the amount of the radial energy thereof.

6. The depressed collector of claim 5, wherein said first electrode is generally funnel shaped.

7. The depressed collector of claim 5, wherein said aperture has flared surfaces.

8. The depressed collector of claim 5, wherein said beam travels along a common axis associated with said interaction region and said collector, and a majority of a total energy of the electrons entering the collector comprises said radial energy and is in a radial direction transverse to said axis.

9. A depressed collector for use with a microwave device having an interaction region, said microwave device providing an electron beam that is transmitted through said interaction region and into said collector, said collector recovering energy remaining in said electron beam after passing through said interaction region, said collector comprising:

a collector support structure; and means for sorting electrons of said electron beam within said support structure, said electrons having varying radial energy levels, said sorting means sorting said electrons on the basis of their respective radial energy levels, wherein a majority of the energy of the electrons within the collector is in a generally radial direction.

10. A depressed collector for use with a microwave device having an interaction region, said microwave device providing an electron beam that is transmitted through said interaction region and into said collector, said collector recovering energy remaining in said electron beam after passing through said interaction region, said collector comprising:

a collector support structure; and means for sorting electrons of said electron beam within said support structure, said electrons having varying radial energy levels, said sorting means sorting said electrons on the basis of their respective radial energy levels, wherein a majority of the energy of the electrons within the collector is in a generally radial direction, and wherein said sorting means further comprises a first electrode having a high negative potential applied thereto with respect to the microwave device, and at least one additional electrode respectively having generally lower relative potential than the high negative potential applied to said first electrode, said first electrode being closest in proximity to said microwave device.

11. The depressed collector of claim 10, wherein said microwave device further comprises a cathode having a potential applied thereto, said cathode emitting said electron beam in response to said potential, and said high negative potential of said first electrode is equal to the potential that is applied to said cathode of said microwave device.

12. The depressed collector of claim 10, wherein said first electrode is generally funnel shaped.

13. The depressed collector of claim 10, wherein said first electrode has surfaces which converge toward said beam.

14. The depressed collector of claim 10, wherein electrons having the highest radial energy level are collected on said first electrode, and electrons having lesser levels of radial energy are collected on respective ones of said additional electrodes.

15. The depressed collector of claim 10, wherein there are two of said additional electrodes.

* * * * *